United States Patent [19]

Crouch

[11] 4,261,766

[45] Apr. 14, 1981

[54] METHOD FOR INHIBITING FATIGUE OF ALUMINUM

[75] Inventor: Robert L. Crouch, Phoenix, Ariz.

[73] Assignee: Early California Industries, Inc., Phoenix, Ariz.

[21] Appl. No.: 159,128

[22] Filed: Jun. 13, 1980

Related U.S. Application Data

[63] Continuation of Ser. No. 56,890, Jul. 12, 1979, abandoned.

[51] Int. Cl.[3] ..... C23F 9/00

[52] U.S. Cl. ..... 148/6.27; 252/387

[58] Field of Search ..... 427/327; 252/141, 387, 252/74, 75, 76; 148/6.27

[56] References Cited

U.S. PATENT DOCUMENTS

| | | | |
|---|---|---|---|
| 2,796,370 | 6/1957 | Ostander et al. | 148/6.2 |
| 3,520,736 | 7/1970 | Newell et al. | 148/6.27 |
| 3,717,510 | 2/1973 | Boose et al. | 148/6.27 |
| 3,907,610 | 9/1975 | Yamagishi | 148/6.27 |
| 3,915,758 | 10/1975 | Weinbaum | 148/6.11 |
| 3,959,521 | 5/1976 | Suetgugi et al. | 427/44 |
| 3,985,585 | 10/1976 | Tuttle et al. | 148/6.27 |

FOREIGN PATENT DOCUMENTS

| | | | |
|---|---|---|---|
| 45-15849 | 6/1970 | Japan | 148/6.27 |

OTHER PUBLICATIONS

Krusenstjern et al., Chem. Abs. 67:46509j 1967.

*Primary Examiner*—Ralph S. Kendall
*Attorney, Agent, or Firm*—Drummond and Nelson

[57] ABSTRACT

A method of inhibiting the fatigue of aluminum comprising the steps of immersing aluminum in an aqueous solution of a water soluble cyanide compound at room temperature and continuously maintaining the aluminum in contact with the aqueous solution. The aqueous solution is substantially free of chromium.

1 Claim, No Drawings

METHOD FOR INHIBITING FATIGUE OF ALUMINUM

This application comprises a continuation of my copending application Ser. No. 56,890 for METHOD FOR INHIBITING FATIGUE CORROSION OF ALUMINUM filed July 12, 1979, abandoned.

This invention concerns a method for inhibiting fatigue.

More particularly, the invention relates to a method for inhibiting the fatigue of aluminum and aluminum alloys.

According to a further aspect, the invention relates to inhibiting fatigue corrosion in aluminum and aluminum alloys.

A number of aluminum corrosion inhibitors are well known in the art. Chromates, in particular sodium dichromate, have long been recognized as one of the better corrosion inhibitors of aluminum.

Another known aluminum corrosion inhibitor is comprised of an aqueous solution of chromic acid or a water soluble chromic salt and, of ferricyanic or ferrocyanic acid or a water soluble salt thereof. See U.S. Pat. Nos. 2,796,371 and 2,796,370 to Ostrander.

A potential drawback of such prior art corrosion inhibitors containing chromates is that the United States Government has, because of believed health hazards, promulgated new regulations on the use of chromates. These pending regulations may sharply curtail the use of chromates.

As is disclosed in my U.S. Pat. No. 4,176,071 for CORROSION INHIBITOR SYSTEM FOR AMMONIUM SULFATE FIRE-RETARDANT COMPOSITIONS AND METHOD FOR INHIBITING CORROSIVITY OF SUCH COMPOSITIONS, the addition of minor amounts of a corrosion inhibitor system comprising a water soluble cyanide compound and a water soluble ortho-phosphate compound to an ammonium sulfate-based fire-retardant composition reduces the corrosivity of aluminum contacted by the fire-retardant composition to less than one mil per year. The corrosion rate of less than one mil per year satisfies the corrosion specification which controls the procurement of forest fire-retardant compositions by the United States Government and various foreign governments.

The above known aluminum corrosion inhibitors are often addressed in terms of reducing the uniform surface corrosion rate of aluminum. However, in addition to surface corrosion, fatigue corrosion is an important contributing factor towards shortening the life of aluminum structural members, especially in cyclical high stress conditions which are encountered in aircraft.

Aluminum, aluminum alloys and other metals are elastic and will, although to an extent much less than encountered in a highly elastic material such as a rubber band, "stretch" and "compress" in reaction to external tensile or compressive forces. In attempting to adapt to the application of such external forces which approach or exceed the yield strength of the metal, units of the metal comprised of thousands of unit cells slide along each other on slip planes.

If the external stress is continued the slip planes increase in size and cracks form which lead to the eventual fracture of the metal. In ductile metals like aluminum the fracture is transcrystalline, or across the crystal comprising the metal, at room temperature. As the temperature approaches the metal's melting point, the fracture becomes intercrystalline such that crystal are torn away from each other at their boundaries. Such intercrystalline or brittle failure is usually sudden and without significant prior deformation of the metal.

The term "fatigue" embraces the above described general sequence of events which occur in reaction to external stress being applied to a metal. In other words a metal fatigues when it, in reaction to external mechanical forces, develops slip planes and cracks. Fracture of the metal part due to external mechanical forces forming slip planes and cracks in the metal, in absence of chemical changes in the composition of the metal, is termed fatigue failure.

Metals are more prone to fatigue under conditions which result in repetition or alternation of stress. This is especially true where the metal is subjected to alternating tensile and compressive forces.

Of importance is the fact that there can be slip in a metal at stresses less than those necessary to produce permanent deformation of the metal. Such "microscopic slip" is a stress raiser which can cause a repetition of the stress to produce a permanent deformation in the metal.

The effectiveness of a stress raiser in causing failure of a material is commonly demonstrated when the surface of glass is scored with a tool prior to being broken. When the glass is, after being scored, subjected to a minimal tensile force across its surface, stress is concentrated in the groove formed on the surface of the glass. The concentration of stress causes the glass to fracture along the line of the groove.

In a similar fashion, stress raisers at the surface of a metal can greatly reduce the tensile force needed to fracture the metal.

Corrosion, in particular uniform surface corrosion, pitting corrosion and intergranular corrosion, creates stress raisers on the surface of a metal. The formation of such stress points on the surface of a metal by the chemical action of corrosion facilitates the formation of slip planes and cracks in the metal. When external mechanical force is applied to a metal, the more easily such slip planes and cracks form, the more easily the metal will fracture.

Intergranular corrosion often begins at the surface of a metal and may then progress rapidly inward into the metal. Certain high strength aluminum alloys containing copper are especially susceptible to intergranular corrosion. However, this problem has been partially overcome by proper heat treatment of and by painting or otherwise coating the aluminum/copper alloy.

The mutual operation of corrosion and fatigue to produce failure of metal members at much lower stresses than expected is termed fatigue corrosion. As was noted in the discussion on intergranular corrosion above, contacting aluminum with a protective coating, in particular a protective coating which adheres well when the aluminum or aluminum alloy member is subjected to stress, is an important method of corrosion and fatigue corrosion prevention.

Although surface corrosion accelerates the fatigue of a metal, fatigue per se is comprised of processes which are distinct and separate from corrosion. As a result, treatments which improve the corrosion resistance of a material do not necessarily improve the fatigue resistance of the material. This phenomenon is demonstrated by data discussed in *Fatigue of Metals* by J. Y. Mann and in *Handbook of Steels and Stress* Charles Lipson and Robert C. Juvinall. Data from these references is presented by Examples 5 and 6 herein.

Improved fatigue resistance does not inherently accompany an improvement in the corrosion resistance of a material. Each particular corrosion inhibiting process must be tested on its merits in combustion with a specific material to determine if the fatigue resistance of the material is improved or reduced.

In accordance with the invention, I have now discovered a method for improving fatigue failure characteristics of aluminum and aluminum alloys comprising the steps of immersing the aluminum in an aqueous solution of a water soluble cyanide compound at room temperature, said aqueous solution being substantially free of chromium, and continuously maintaining the aluminum in contact with the acqueous solution.

The fatigue corrosion inhibiting cyanide compound is typically incorporated into a carrying agent such as water in a minor effective amount sufficient to substantially reduce the fatigue corrosivity of aluminum or aluminum alloys. Dispersing the cyanide in such agents allows contact of the cyanide over a large area. The exact amount of cyanide compound to be incorporated into the carrying agent to achieve such results will vary somewhat, depending on the particular cyanide compound used, the composition of the particular aluminum alloy and other pertinent factors. By way of example, it is generally found that a concentration of about 0.25% by weight of the cyanide compound in water, ethyl alcohol or acetone will provide the desired degree of corrosion inhibition of aluminum or aluminum alloys.

The cyanide compound which is utilized in the practice of the invention can be any cyanide compound containing a $CN^-$ group. When the cyanide compound is dispersed in a carrying solution, the cyanide compound employed is preferably soluble in the particular carrying agent. For example, where the carrying agent is water, such water soluble inorganic complex cyanides as alkali metal, of alkaline earth metal ferrocyanide, ferricyanide, or nitroprussides are preferred. Included in this group are complex cyanide salts such as sodium or potassium ferrocyanide, sodium or potassium nitroprusside, sodium or potassium ferricyanide, as well as other water soluble complex cyanide compounds such as potassium hexacyanocoboltate, ammonium nitroferrocyanide and the like. If the carrying agent is alcohol, potassium nitroprusside, potassium ferricyanide, sodium cyanide, ammonium cyanide and ammonium cyanate are preferred. Potassium ferricyanide and potassium ferrocyanide may also be used where the carrying agent is acetone. In the preferred embodiment of the invention, I use sodium ferrocyanide.

The following examples are presented, not by way of limitation of the scope of the invention, but to illustrate to those skilled in the art the practice of various of the presently preferred embodiments of the invention and to distinguish the invention from the prior art.

EXAMPLE 1

This example illustrates the improvement in corrosion fatigue characteristics of aluminum which results from contacting the metal with a fire-retardant composition containing the cyanide component of the corrosion inhibitor system of the present invention.

A test specimen of aluminum alloy (2024-T3) measuring $14'' \times \frac{1}{2}'' \times \frac{1}{4}''$ is oriented in the long transverse direction, notched at the center, degreased and inserted through slits cut in the side wall of a polyethylene bottle. The slits are sealed around the test beam with silicone caulking and the bottle is filled with corrosion inhibited fire-retardant composition described in Example 1 of my issued U.S. Pat. No. 4,176,071 for CORROSION INHIBITOR SYSTEM FOR AMMONIUM SULFATE FIRE-RETARDANT COMPOSITIONS AND METHOD FOR INHIBITING CORROSIVITY OF SUCH COMPOSITIONS. The ends of the specimen are then attached to the vice and the crank of a Fatigue Dynamics VSP-150 plate bending machine and the loading is adjusted to 11 Ksi.

The test beam is then stressed at 100 cycles per minute at 70° F. until the specimen breaks.

With only air in polyethylene bottle, the test specimen breaks at 525,000 cycles. Duplicate tests with the bottle filled with the corrosion inhibited fire-retardant composition containing 0.125 wt % sodium ferrocyanide were conducted and the following data obtained:

| Test Number | Cycles to Failure |
|---|---|
| 1 | 811,000 |
| 2 | 1,075,500 |

EXAMPLE 2

This example illustrates the improvement in fatigue and fatigue corrosion characteristics of aluminum which results from contacting the metal with a composition of water and a cyanide component.

A test specimen of aluminum alloy (2024-T3) measuring $0.25'' \times 0.50'' \times 14''$ is oriented in the long transverse direction, notched at the center, degreased and inserted through slits cut in the side wall of a polyethylene bottle. The slits are sealed around the test beam with silicone caulking and the bottle is filled with the corrosion inhibiting composition of deionized water containing 0.25% by weight sodium ferrocyanide. The ends of the specimen are then attached to the vice and the crank of a Fatigue Dynamics VSP-150 plate bending machine and the loading is adjusted to 6800 psi.

The test beam is then stressed at 100 cycles/min. at 70° F. until the specimen breaks.

With only deionized water in the polyethylene bottle, the test specimen breaks at 720,000 cycles. With a solution of deionized water containing 0.25% by weight sodium chromate, the test specimen breaks at 854,000 cycles. Duplicate tests with the bottle filled with deionized water containing 0.25% by weight sodium ferrocyanide were conducted and the following data obtained:

| Test Number | Cycles to Failure |
|---|---|
| 1 | 1,010,100* |
| 2 | 1,404,000* |
| 3 | 1,203,100* |

*The aluminum bar did not fail.

As is known to those skilled in the art, the oxide layer which normally forms on the surface of aluminum is very resistant to ordinary water. Similary, it is now known that cyanide is an equally effective corrosion inhibitor for aluminum. Thus, when the aluminum bar was immersed in the aqueous solution of dionized water containing a sodium ferrocyanide, the aluminum bar was placed in a solution which would cause minimal corrosion. The failure of the aluminum bar was therefore predominantly due to the effects of fatigue.

EXAMPLE 3

When ethyl alcohol is substituted for deionized water in the procedure of Example 2, results are obtained which are essentially equivalent to those arrived at in Example 2.

EXAMPLE 4

When acetone is substituted for deionized water in the procedure of Example 2, results are obtained which are essentially equivalent to those arrived at in Example 2.

EXAMPLE 5

This example illustrates how treating a material to improve the corrosion resistance thereof may reduce the fatigue resistance of the material. The following Table is from the *Fatigue of Materials* by J. Y. Mann, Cambridge University Press, 1967, p. 104.

TABLE VIII

Influence of Protective Coatings on the Air and Salt-spray Corrosion-fatigue Properties of 0.5% C Steel

| | As Drawn U.T.S. 146,000 p.s.i. | | | Normalized U.T.S. 93,000 p.s.i. | | |
|---|---|---|---|---|---|---|
| Type of Coating | Air* | Salt Spray+ | * | Air* | Salt Spray+ | * |
| Untreated (U) | 55,000 | 8,000 | 15 | 37,000 | 9,000 | 25 |
| Brushed enamel (varnish) | 51,000 | 24,000 | 45 | 38,500 | 25,000 | 70 |
| Hot dip galvanized | 55,500 | 52,000 | 95 | 33,000 | 37,000 | 100 |
| Zinc plating | 54,500 | 48,000 | 85 | 36,000 | 33,000 | 90 |
| Cadmium plating | 51,000 | 42,500 | 75 | 34,000 | 30,500 | 80 |
| Aluminium sprayed | 58,000 | 43,500 | 80 | | | |

*Fatigue limit in air (p.s.i.).

+ Fatigue strength at $2 \times 10^7$ cycles (p.s.i.).

*Fatigue strength at $2 \times 10^7$ cycles in salt spray/fatigue limit untreated in air (U)—%.

EXAMPLE 6

This example illustrates how treating a material to improve the corrosion resistance thereof may reduce the fatigue resistance of the material. The following excerpt is from *Handbook of Steels and Stress* by Charles Lipson and Robert C. Juvinall, the McMillan Company, New York, 1963, p. 152.

TABLE 13-5

Effect of Fresh Water Corrosioin on Endurance Limit

| Condition | Endurance Limit in Air psi | Endurance Limit in Fresh Water psi | Percentage Decrease Due to Corrosion |
|---|---|---|---|
| Uncoated | 31,000 | 15,500 | 50 |
| Copper plated | 28,000 | 28,000 | 0 |
| Nickel plated | 23,500 | 23,500 | 0 |
| Chromium plated | 33,000 | 33,000 | 0 |

The general effect of chromium plating on the fatigue strength of steel is to reduce the endurance limit; under particularly unfavorable conditions it has been reduced to 35 percent of the value for the unplated steel. The extent to which the endurance limit may be reduced in any particular chrome plated part depends upon the plating process and the steel base. Some important factors are the current density, and temperature at which plating is accomplished, the thickness of the plating, the chemical composition of the steel base, and the hardness of the steel base. Results of tests conducted on various steels and under variable plating conditions do not follow a consistent trend. Therefore, general rules and values cannot be derived with which to determine the decrease in endurance limit. Thus, experimental testing must be resorted to in order to determine the endurance limit of a chrome plated part under particular plating conditions. An indication of the magnitude of decrease in strength which may be associated with chromium plating is given in Table 13-6.

TABLE 13-6

Fatigue Strength of Chromium Plated Parts

| Steel | Treatment | Plating Thickness in. | Endurance Limit psi | Percentage Decrease Due to Plating |
|---|---|---|---|---|
| Cr-Mo-V | | None | 74,000 | 0 |
| Cr-Mo-V | Plated 15 hr. | 0.0015 | 68,000 | 8 |
| Cr-Mo-V | Plated 8 hr. | 0.006 | 64,000 | 14 |
| Cr-Mo-V | Plated 8 hr., tempered 250° C. | 0.008 | 31,000 | 58 |
| Cr-Mo-V | Plated 1 hr., tempered 250° C. | 0.0015 | 62,000 | 16 |
| SAE 6130 | Normalized, not plated | None | 33,000 | 0 |
| SAE 6130 | Normalized, plated | 0.00018 | 30,000 | 9 |
| SAE 6130 | Normalized, plated | 0.0045 | 32,000 | 3 |
| SAE 6130 | Quenched-and-drawn, not plated | None | 65,500 | 0 |
| SAE 6130 | Quenched-and-drawn, plated | 0.00015 | 38,000 | 57 |
| SAE 6130 | Quenched-and-drawn, plated | 0.0045 | 41,000 | 38 |

Having described my invention in such clear and concise and exact terms as to enable those skilled in the art to which it pertains to understand and practice it, and having identified the presently preferred embodiment thereof,

I claim:

1. The method for increasing the fatigue resistance of aluminum and aluminum alloys consisting essentially of the steps of (a) immersing said aluminum in an aqueous solution of a water soluble cyanide compound at room temperature, said aqueous solution being substantially free of chromium, and (b) continuously maintaining said aluminum in contact with said aqueous solution.

* * * * *